US010589145B1

(12) United States Patent
Lin

(10) Patent No.: US 10,589,145 B1
(45) Date of Patent: Mar. 17, 2020

(54) SWINGABLE EXERCISE BIKE

(71) Applicant: BH ASIA LTD., Taichung (TW)

(72) Inventor: Fu Hai Lin, Taichung (TW)

(73) Assignee: BH Asia Ltd., Taichung (TW)

( * ) Notice: Subject to any disclaimer, the term of this patent is extended or adjusted under 35 U.S.C. 154(b) by 0 days.

(21) Appl. No.: 16/115,924

(22) Filed: Aug. 29, 2018

(51) Int. Cl.
*A63B 22/00* (2006.01)
*A63B 22/06* (2006.01)

(52) U.S. Cl.
CPC ..... *A63B 22/0058* (2013.01); *A63B 22/0087* (2013.01); *A63B 22/06* (2013.01)

(58) Field of Classification Search
CPC ..... A63B 22/0058; A63B 22/008; A63B 22/06–0605; A63B 2022/0611–0658; A63B 69/16; A63B 2069/161–168; A63B 23/0476
See application file for complete search history.

(56) References Cited

U.S. PATENT DOCUMENTS 4,082,265 A * 4/1978 Berkes ..... A63B 22/16 280/293
4,817,939 A * 4/1989 Augspurger ..... A63B 22/16 482/2
6,126,577 A * 10/2000 Chang ..... A63B 26/003 434/61
6,322,480 B1 * 11/2001 Lim ..... A63B 26/003 472/103
6,709,367 B1 * 3/2004 Liang ..... A63B 22/0058 482/146
6,712,739 B1 * 3/2004 Chen ..... A63B 22/0056 482/53
7,682,286 B2 * 3/2010 Badarneh ..... A63B 26/003 482/4
9,987,514 B1 * 6/2018 Tung ..... A63B 22/0605
10,039,954 B1 * 8/2018 Tung ..... A63B 22/0056 482/53
2002/0077221 A1 * 6/2002 Dalebout ..... A63B 26/003 482/57
2005/0085354 A1 * 4/2005 Rice ..... A63B 22/0012 482/121
2005/0209064 A1 * 9/2005 Peterson ..... A63B 22/16 482/61
2007/0054782 A1 * 3/2007 Lin ..... A63B 21/015 482/57
2008/0020908 A1 * 1/2008 Ibarguren ..... A63B 22/0605 482/57

(Continued)

*Primary Examiner* — Andrew S Lo
(74) *Attorney, Agent, or Firm* — Rosenberg, Klein & Lee

(57) ABSTRACT

A swingable exercise bike includes a base having a first pivot portion for a bike body to be pivotally connected to the first pivot portion so that the bike body can swing left and right relative to the base. Left and right sides of the first pivot portion are provided with first connecting rods. The first connecting rods each have one end pivoted to the base and another end extending in a height direction and pivoted to a second connecting rod. The second connecting rod is further pivoted to the bike body. When the bike body swings left and right, the first and second connecting rods are pivoted. The two second connecting rods are connected with a cushion device disposed in a horizontal direction, which can generate a damping effect when the two second connecting rods are pivoted by the bike body, thereby cushioning the swing of the bike body.

4 Claims, 5 Drawing Sheets

(56) References Cited

U.S. PATENT DOCUMENTS

| | | | | |
|---|---|---|---|---|
| 2012/0071301 | A1* | 3/2012 | Kaylor | A63B 21/00058 482/57 |
| 2014/0148312 | A1* | 5/2014 | Lo | A63B 22/0605 482/57 |
| 2015/0111704 | A1* | 4/2015 | Lin | A63B 22/0605 482/57 |
| 2015/0238797 | A1* | 8/2015 | Irving | A63B 21/225 482/57 |
| 2015/0238808 | A1* | 8/2015 | Lin | A63B 22/0605 482/57 |
| 2015/0290490 | A1* | 10/2015 | Badarneh | A63B 22/0023 482/6 |
| 2016/0158620 | A1* | 6/2016 | Bauer | A63B 69/16 482/61 |
| 2016/0236036 | A1* | 8/2016 | Kalogiros | A63B 69/16 |
| 2016/0236055 | A1* | 8/2016 | Kalogiros | A63B 69/16 |
| 2016/0287931 | A1* | 10/2016 | Tung | A63B 22/16 |
| 2017/0136293 | A1* | 5/2017 | Caccia | A63B 69/16 |
| 2019/0070456 | A1* | 3/2019 | Tung | A63B 22/0058 482/146 |

* cited by examiner

SWINGABLE EXERCISE BIKE

FIELD OF THE INVENTION

The present invention relates to an exercise training device, and more particularly to a swingable exercise bike.

BACKGROUND OF THE INVENTION

According to the trend in sports, people may go to the gym or buy an exercise bike at home for exercise. The bike body of most conventional exercise bikes is stationary, that is, the bike body is fixed to a base. The user stably rides on the bike body and continuously treads to generate a sports effect.

The pedaling action of the exercise bike described above is slightly monotonous, and the user is prone to be inpatient and cannot continue to exercise. Therefore, another exercise bike has been developed on the market. As shown in FIG. 5, a bike body 41 is pivotally connected to a pivot portion 42 of a base 4, allowing the bike body 41 to swing left and right relative to the base 4, so that the user can experience the actual feeling of riding a bike to enhance the fun during the exercise.

For the safety during the exercise, the base 4 is provided with elastic members 43 at both sides of the pivot portion 42 as a cushion. When the bike body swings left and right, it is pressed against the elastic member 43 on the corresponding side to obtain the cushioning resistance, so as to prevent the user from falling and being injured. In the above-mentioned conventional structure, the elastic member 43 is disposed in an upright manner. When it is pressed, a deformation in the height direction is generated to provide a cushioning resistance in the height direction. But, the swinging motion of the bike body 41 is performed along a curved trajectory. It is difficult for the upright elastic member 43 to stably support the swinging bike body 41, with safety concerns. Accordingly, the inventor of the present invention has devoted himself based on his many years of practical experiences to solve these problems.

SUMMARY OF THE INVENTION

The primary object of the present invention is to provide a swingable exercise bike. A cushion device for cushioning the swing of a bike body provides horizontal support, thereby ensuring that the bike body obtains stable support to prevent the user from falling and being injured.

In order to achieve the aforesaid object, a swingable exercise bike is provided. The swingable exercise bike comprises a base, a supporting mechanism, and a cushion device. The base has a first pivot portion for a bike body to be pivotally connected to the first pivot portion so that the bike body is able to swing left and right relative to the base. The supporting mechanism includes two first connecting rods located at left and right sides of the first pivot portion. The first connecting rods each have one end pivotally connected to the base and another end extending in a height direction and pivotally connected to a second connecting rod. The second connecting rod is further pivotally connected to the bike body. When the bike body swings left and right, the first connecting rods and the second linking rods are pivoted. The cushion device is disposed in a horizontal direction and has two ends respectively connected to the two second connecting rods for generating damping when the two second connecting rods are pivoted by the bike body.

In an embodiment, the base is provided with second pivot portions at the left and right sides of the first pivot portion for pivotal connection of the first connecting rods. The second connecting rod has a length less than a distance between the first pivot portion and the second pivot portion.

In an embodiment, pivotal positions at which the two second connecting rods of the supporting mechanism are connected to the bike body are at a same height.

In an embodiment, the cushion device includes a damper and two supports. The two supports are located at the left and right sides of the first pivot portion and fixed to the second connecting rods, respectively. Two ends of the damper are pivotally connected to the two supports, respectively.

DETAILED DESCRIPTION OF THE PREFERRED EMBODIMENTS

Embodiments of the present invention will now be described, by way of example only, with reference to the accompanying drawings.

Figure 1:
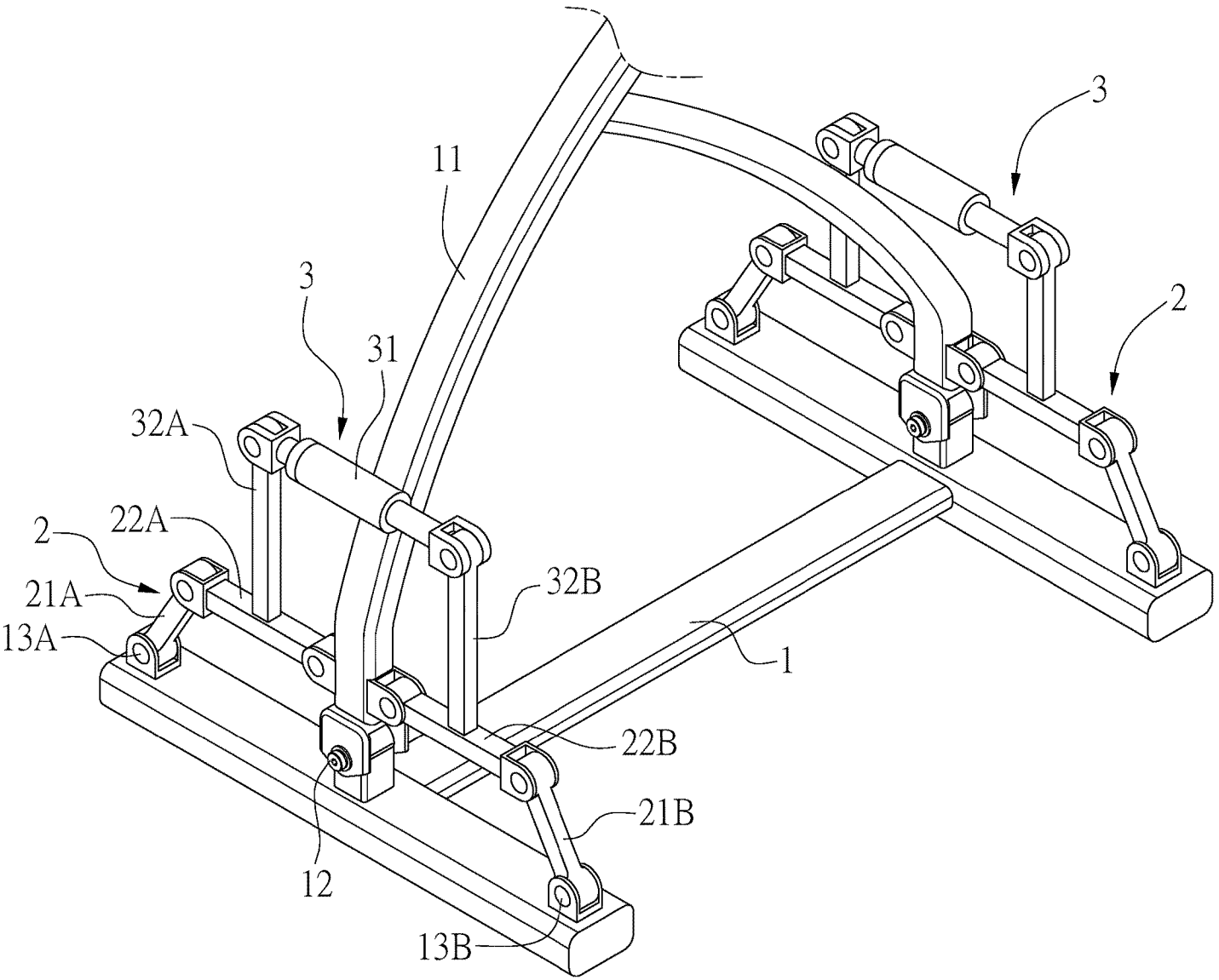
FIG. 1 is a perspective view of the present invention.
Figure 2:
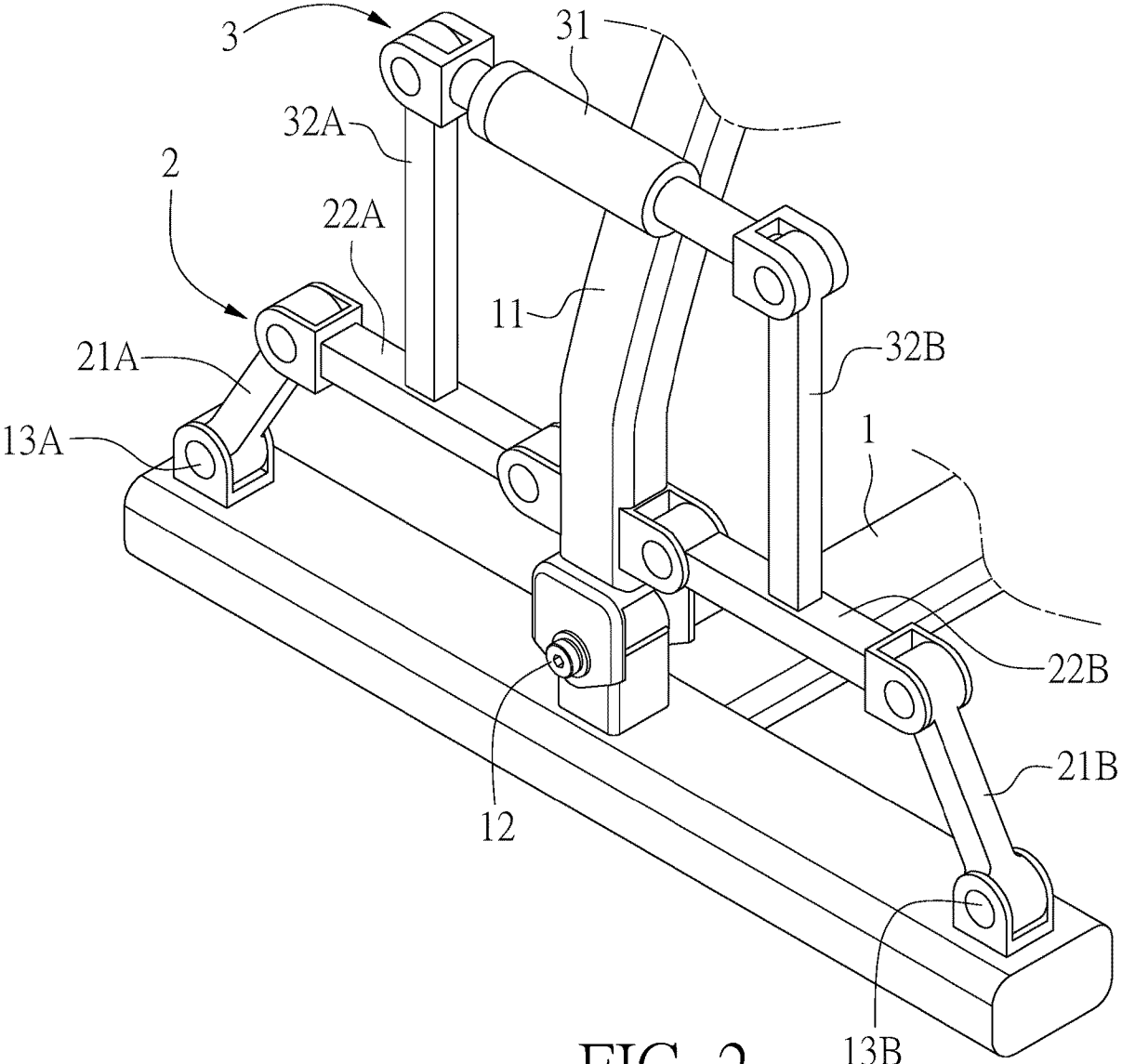
FIG. 2 is a partially enlarged view of the present invention.

Referring to FIG. 1 and FIG. 2, the present invention discloses a swingable exercise bike, comprising a bike body 11 and a base 1. The bike body 11 is a flywheel structure of any type in the prior art. The bike body 11 comprises a frame, a seat, an armrest, a rotating wheel, a pedal, a resistance wheel (not shown), and so on. The front and rear ends of the base 1 are provided with first pivot portions 12, respectively. The bike body 11 is pivotally connected to the first pivot portions 12, so that the bike body 11 is able to swing left and right relative to the base 1.

The front and rear ends of the base 1 are provided with supporting mechanisms 2 corresponding to the first pivot portions 12, respectively. As shown in FIG. 2, each supporting mechanism 2 includes two first connecting rods 21A, 21B located at left and right sides of the first pivot portion 12. The base 1 is provided with second pivot portions 13A, 13B at the left and right sides of the first pivot portion 12. The first connecting rods 21A, 21B each have one end pivotally connected to the second pivot portion 13A, 13B and another end extending in the height direction and pivotally connected to a second connecting rod 22A, 22B. Another end of the second connecting rod 22A, 22B is pivotally connected to the bike body 11. The pivotal positions at which the two second connecting rods 22A, 22B are connected to the bike body 11 are at the same height. In this embodiment, the length of the second connecting rod 22A, 22B is less than the distance between the first pivot portion 12 and the second pivot portion 13A, 13B. Thereby, the first connecting rod 21A, 21B is set to be inclined toward the first pivot portion 12 when the bike body 11 is not swung. In detail, the first connecting rod 21A located at the left side of the first pivot portion 12 is inclined toward the right side, and the first connecting rod 21B located at the right side of the first pivot portion 12 is inclined toward the left side. With the above structure, when the bike body 11 swings left and right relative to the base 1, the second connecting rods 22A, 22B are driven to link the first connecting rods 21A, 21B to generate a pivot.

Furthermore, the supporting mechanism 2 is provided with a cushion device 3. The cushion device 3 includes a damper 31 and two supports 32A, 32B. The two supports 32A, 32B are located at the left and right sides of the first pivot portion 12, respectively. The bottom ends of the two supports 32A, 32B are fixed to the second connecting rods 22A, 22B, respectively. The top ends of the two supports 32A, 32B extend upwardly. Two ends of the damper 31 are pivotally connected to the top ends of the two supports 32A, 32B, respectively. The damper 31 is disposed in the horizontal direction and is a device that can change in length, thereby absorbing the applied force and generating a cushioning effect. When the bike body 11 swings left and right relative to the base 1, the second connecting rods 22A, 22B are pivoted by the bike body 11 to drive the two supports 32A, 32B to change the distance between the two supports 32A, 32B, thereby compressing or extending the damper 31 to provide a cushioning effect.

Figure 3:
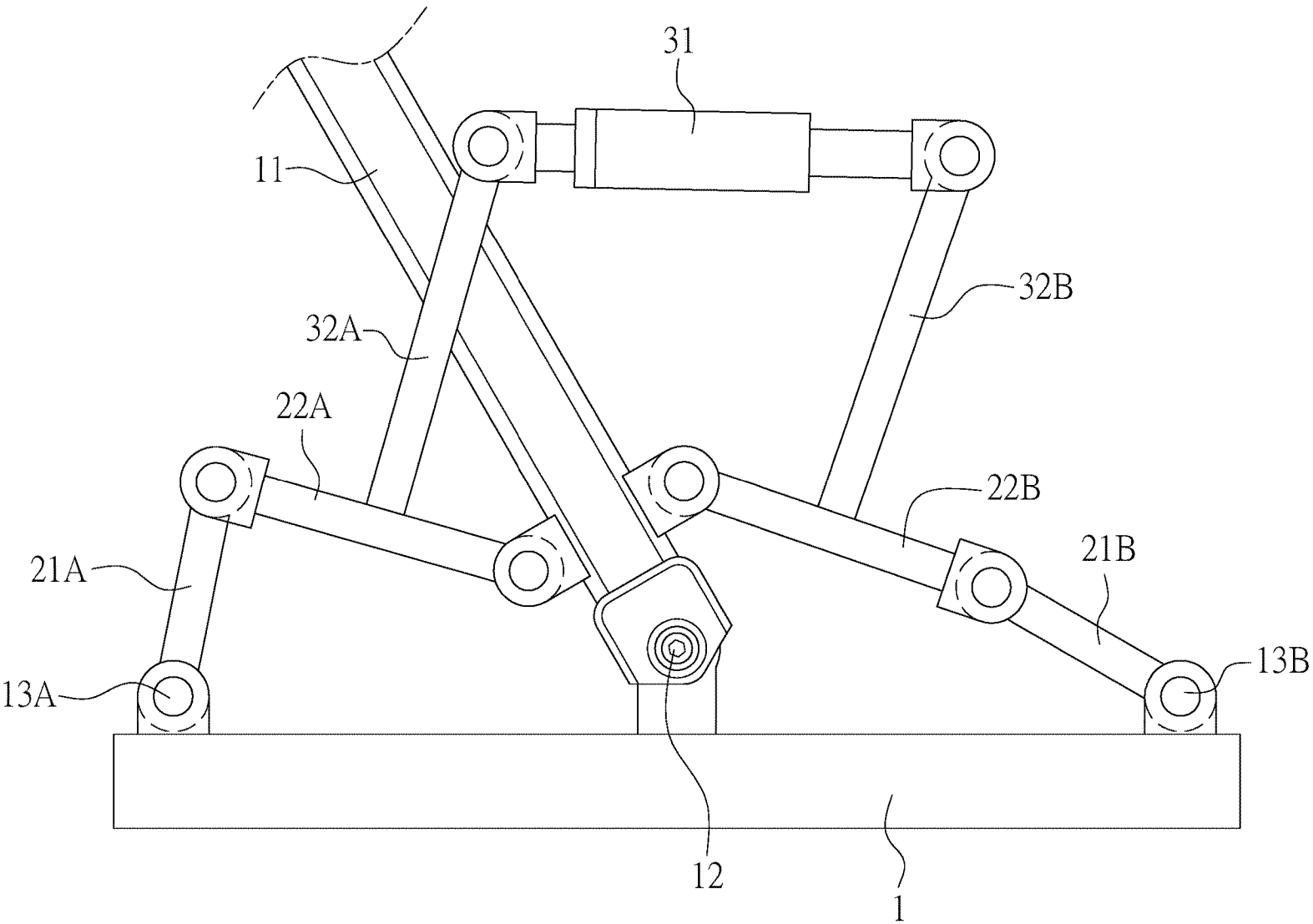
FIG. 3 and FIG. 4 are schematic views of the present invention when in use.

With the above configuration, when the user swings the bike body 11 left, as shown in FIG. 3, the bike body 11 pushes and pulls the second connecting rods 22A, 22B at the two sides thereof, so that the two supports 32A, 32B are linked to compress or extend the damper 31. Accordingly, the action of swinging the bike body 11 to the left side is buffered, and the swing can be performed more stably to prevent the user from falling and being injured. Since the bike body 11 swings to the left side to pivot the second connecting rods 22A, 22B, the first connecting rods 21A, 21B are also pivoted. The first connecting rod 21A located at the left side is linked to pivot left, but does not swing beyond the left of its axis, thereby making the swing of the bike body 11 more stable and being supported.

Figure 4:
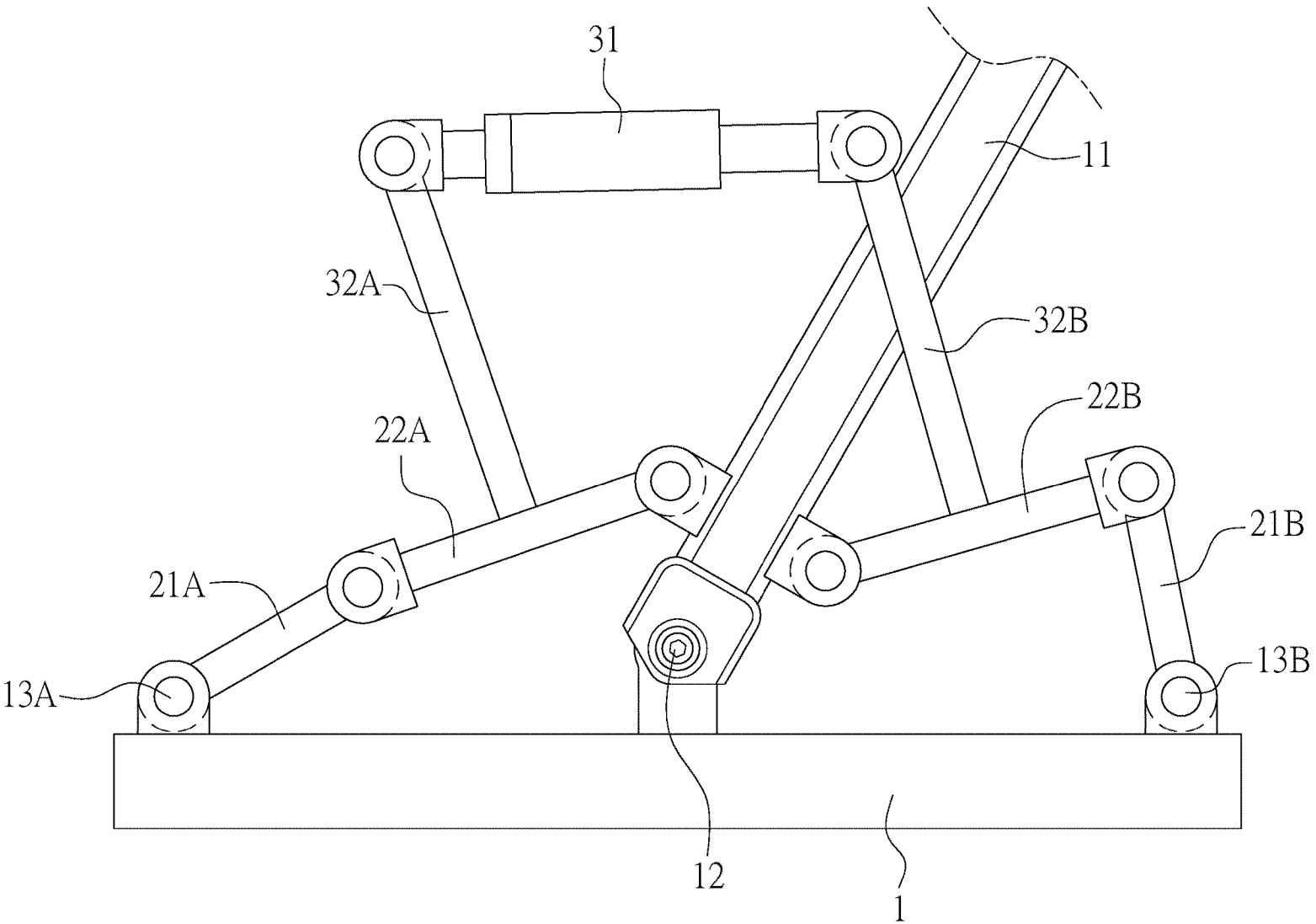
Figure 5:
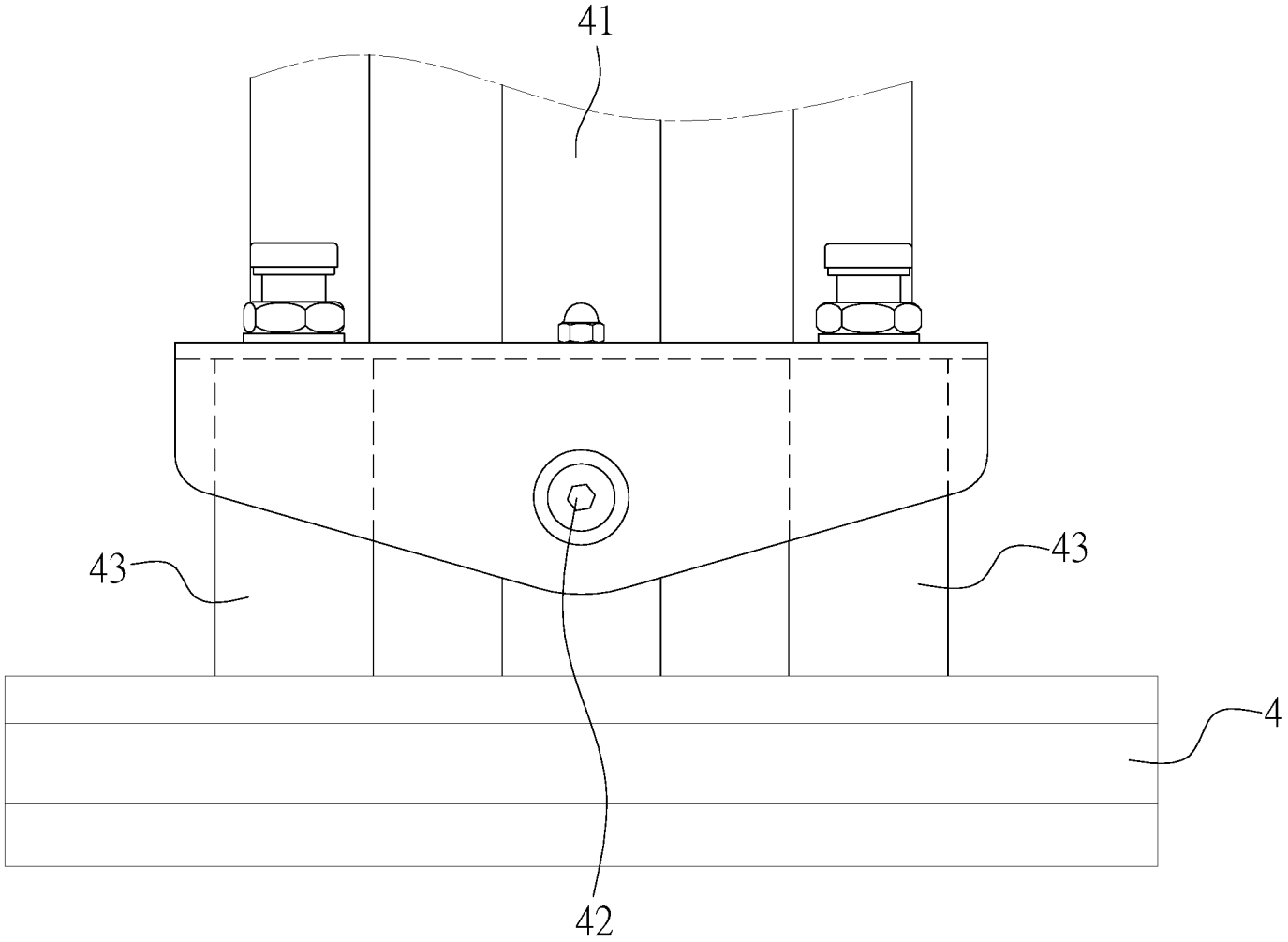
FIG. 5 PRIOR ART
FIG. 5 a planar view of the prior art.

On the other hand, when the user swings the bike body 11 right, as shown in FIG. 4, the bike body 11 pushes and pulls the second connecting rods 22A, 22B at the two sides thereof, so that the two supports 32A, 32B are linked to compress or extend the damper 31. Accordingly, the action of swinging the bike body 11 to the right side is buffered, and the swing can be performed more stably to prevent the user from falling and being injured. Since the bike body 11 swings to the right side to pivot the second connecting rods 22A, 22B, the first connecting rods 21A, 21B are also pivoted. The first connecting rod 21A located at the right side is linked to pivot right, but does not swing beyond the right of its axis, thereby making the swing of the bike body 11 more stable and being supported.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A swingable exercise bike, comprising:

a base having a pair of first pivot portions respectively pivotally connected to a bike body at opposing longitudinal ends of the base for enabling the bike body to swing from side to side relative to the base;

two first connecting rods and two second connecting rods disposed at each of the opposing ends of the base, the two first connecting rods at each of the opposing ends of the base being respectively located at opposing sides of a respective one of the first pivot portions, the first connecting rods each having one end pivotally connected to the base and another end extending in a height direction and pivotally connected to a corresponding one of the two second connecting rods, each of the two second connecting rods being further pivotally connected to the bike body adjacent a corresponding opposing end of the base; wherein when the bike body swings from side to side, the first connecting rods and the second connecting rods at each of the opposing ends of the base are respectively pivoted;

a pair of dampers disposed at each of the opposing ends of the base in a horizontal direction, and each of the pair of dampers having opposing ends each being connected to a respective one of the corresponding two second connecting rods for generating a damping effect when the corresponding two second connecting rods are pivoted by the bike body.

2. The swingable exercise bike as claimed in claim 1, wherein the base is provided with a pair of second pivot portions at each of the opposing ends of the base, each of the pair of second pivot portions being respectively located at the opposing sides of a respective one of the first pivot portions to be pivotally connected to corresponding first connecting rods, and each of the second connecting rod at each of the opposing ends of the base has a length less than a distance between the respective one of first pivot portions and one of the corresponding second pivot portions.

3. The swingable exercise bike as claimed in claim 1, wherein two pivotal positions at which the two second connecting rods at each of the opposing ends of the base are respectively connected to the bike body are at a same height.

4. The swingable exercise bike as claimed in claim 1, further comprising two supports at each of the opposing ends of the base, the two supports being located at respective opposing sides of the respective one of the first pivot portions and fixed to a corresponding one of the second connecting rods, and two opposing ends of a corresponding one of the pair of dampers each being pivotally connected to a respective one of the two supports at each of the opposing ends of the base.

* * * * *